US006750839B1

(12) United States Patent
Hogan

(10) Patent No.: US 6,750,839 B1
(45) Date of Patent: Jun. 15, 2004

(54) GRAYSCALE REFERENCE GENERATOR

(75) Inventor: Roderick B. Hogan, Sunnyvale, CA (US)

(73) Assignee: Analog Devices, Inc., Norwood, MA (US)

( * ) Notice: Subject to any disclaimer, the term of this patent is extended or adjusted under 35 U.S.C. 154(b) by 218 days.

(21) Appl. No.: 10/138,093

(22) Filed: May 2, 2002

(51) Int. Cl.[7] ..... G09G 3/36
(52) U.S. Cl. ..... 345/98; 345/89
(58) Field of Search ..... 345/98, 87, 88, 345/89, 96, 94, 99, 100, 690, 213, 211

(56) References Cited

U.S. PATENT DOCUMENTS 5,229,761 A * 7/1993 Fuse ..... 345/99
5,999,242 A * 12/1999 Walton et al. ..... 349/148
6,211,866 B1 * 4/2001 Okutani ..... 345/209
6,570,560 B2 * 5/2003 Hashimoto ..... 345/211
6,661,413 B2 * 12/2003 Sakaguchi ..... 345/211

OTHER PUBLICATIONS

Analog Devices, Integrated LCD Grayscale Generator, Preliminary Technical Data CST20, Apr. 5, 2001, p.1–14.

* cited by examiner

*Primary Examiner*—Kent Chang
(74) *Attorney, Agent, or Firm*—Koppel, Jacobs, Patrick & Heybl

(57) ABSTRACT

A grayscale reference generator provides correction voltages to respective connection points on a source driver which drives an array of LCD pixels, to compensate for pixel non-linearity. The generator includes a number of DACs equal to the number of correction voltages. In a preferred embodiment, an analog multiplexer connected between the DACs and the source driver's connection points selectively connects the DAC outputs to the connection points so that the source driver produces the necessary pixel drive voltages as the voltage polarity across the pixels is periodically reversed.

13 Claims, 4 Drawing Sheets

VP Curve showing programming overlap

VN Curve showing programming overlap

GRAYSCALE REFERENCE GENERATOR

BACKGROUND OF THE INVENTION

1. Field of the Invention

This invention relates to the field of liquid crystal device (LCD) displays, and particularly to grayscale reference generators for such displays.

2. Description of the Related Art

LCD display panels are made up of pixels, with each pixel's transparency varying with the voltage applied across it. The "source driver" circuit which provides the voltages applied to the pixels is typically a simple digital-to-analog converter (DAC). The DAC consists of a series string of resistors with a voltage connected across it such that unique voltages are produced at each resistor-resistor junction, followed by a multiplexer which passes on one of the produced voltages in response to a digital code. As the digital code to the mux is increased from zero-scale to full-scale, the voltage applied across a pixel increases linearly. Unfortunately, the relationship between pixel transparency and applied voltage is non-linear; as such, applying a drive voltage which is ¼ of full scale may not result in a ¼ brightness level from an addressed pixel.

Another problem associated with LCD displays is "ghosting". Ghosting is avoided by maintaining a near-zero average DC voltage across the pixels. This is accomplished by periodically alternating the polarity of the voltage applied across each pixel. This can be done by, for example, periodically switching one terminal of a pixel between ground and a positive supply voltage, while changing the drive voltages applied to the pixel's other terminal in synchronization with the switching of the first terminal so as to maintain a constant absolute voltage across the pixel.

Two methods are commonly used to compensate for pixel non-linearity. One method is to correct the non-linearity digitally with the use of a lookup table: the digital code selects an address in a lookup table, which presents a corrected code to the DAC. However, this approach requires what may be an unacceptable amount of computing overhead.

A second approach to correcting the non-linearity involves "bending" the DAC at certain points along the resistor string, using a grayscale reference generator. Several correction voltages are applied to selected resistor-resistor junctions, such that the DAC's transfer characteristic is made linear between pairs of correction points (though the DAC's overall transfer function may now be non-linear). When properly arranged, linearly incrementing the digital code to the DAC causes the transparency of a driven pixel to vary linearly. However, because of display non-idealities, when the voltage polarity across a pixel is reversed, different correction voltages may be required to correct for non-linearity.

One method of generating the necessary correction voltages uses on-board resistors to set the correction voltage levels. This requires the use of fabrication masks to select and interconnect the proper resistors, which can be costly and time-consuming. Alternatively, external resistors could be used, but this provides limited accuracy and adversely affects package pin count.

Another method employs a number of DACs equal to twice the number of correction points, with half the DACs providing the necessary correction voltages when the voltage across a pixel has a first polarity, and the remaining DACs providing the necessary correction voltages when the voltage polarity across a pixel is reversed. This scheme requires that each DAC cover the full "pixel voltage range"; as used herein, the "pixel voltage range" is the voltage range required to turn a pixel from fully off to fully on. As such, this approach is inefficient in terms of both power consumption and die area.

SUMMARY OF THE INVENTION

A grayscale reference generator is presented which overcomes the problems noted above, using a small number of DACs to provide the necessary correction voltages for an LCD display panel. In one embodiment, each DAC need cover only a limited portion of the full pixel voltage range, thereby increasing accuracy while reducing power consumption and die area.

The present generator is suitable for use with LCD pixels which are responsive over a predetermined pixel voltage range, and which are driven with a source driver having a series string of resistors with connection points for receiving correction voltages. The reference generator includes a plurality of DACS, each of which is arranged to output a respective one of the correction voltages needed to correct pixel non-linearity in response to a digital code word. Each DAC is arranged such that its correction voltage is variable over at least a portion of the predetermined pixel voltage range.

The DACs are preferably driven by a digital multiplexer. The digital mux receives two sets of digital code words: one set which sets the DACs when the polarity across an addressed pixel is positive, and a second set which sets the DACs when the polarity across an addressed pixel is negative. This approach reduces the number of DACs required to produce the correction voltages by half when compared with the prior art method described above.

In a preferred embodiment, the present grayscale reference generator also includes an analog multiplexer connected between the DAC outputs and the resistor string connection points, which is arranged to connect the DAC outputs to the connection points so that the resistor string produces the necessary pixel drive voltages as the polarity of the pixel voltages is periodically reversed. With the analog mux in place, a given DAC's output can be connected near one end of the resistor string when the polarity of the voltage across a pixel is positive, and then switched to a connection point near the other end of the string when the pixel voltage polarity is reversed. In this way, the number of DACs need only be equal to the number of connection points, yet correction voltages for both pixel voltage polarities are provided. Because each DAC need only cover a limited portion of the pixel voltage range, accuracy is improved and power consumption and die area are reduced—when compared with a scheme using DACs which must cover the full pixel voltage range.

Further features and advantages of the invention will be apparent to those skilled in the art from the following detailed description, taken together with the accompanying drawings.

DETAILED DESCRIPTION OF THE INVENTION

Figure 1:
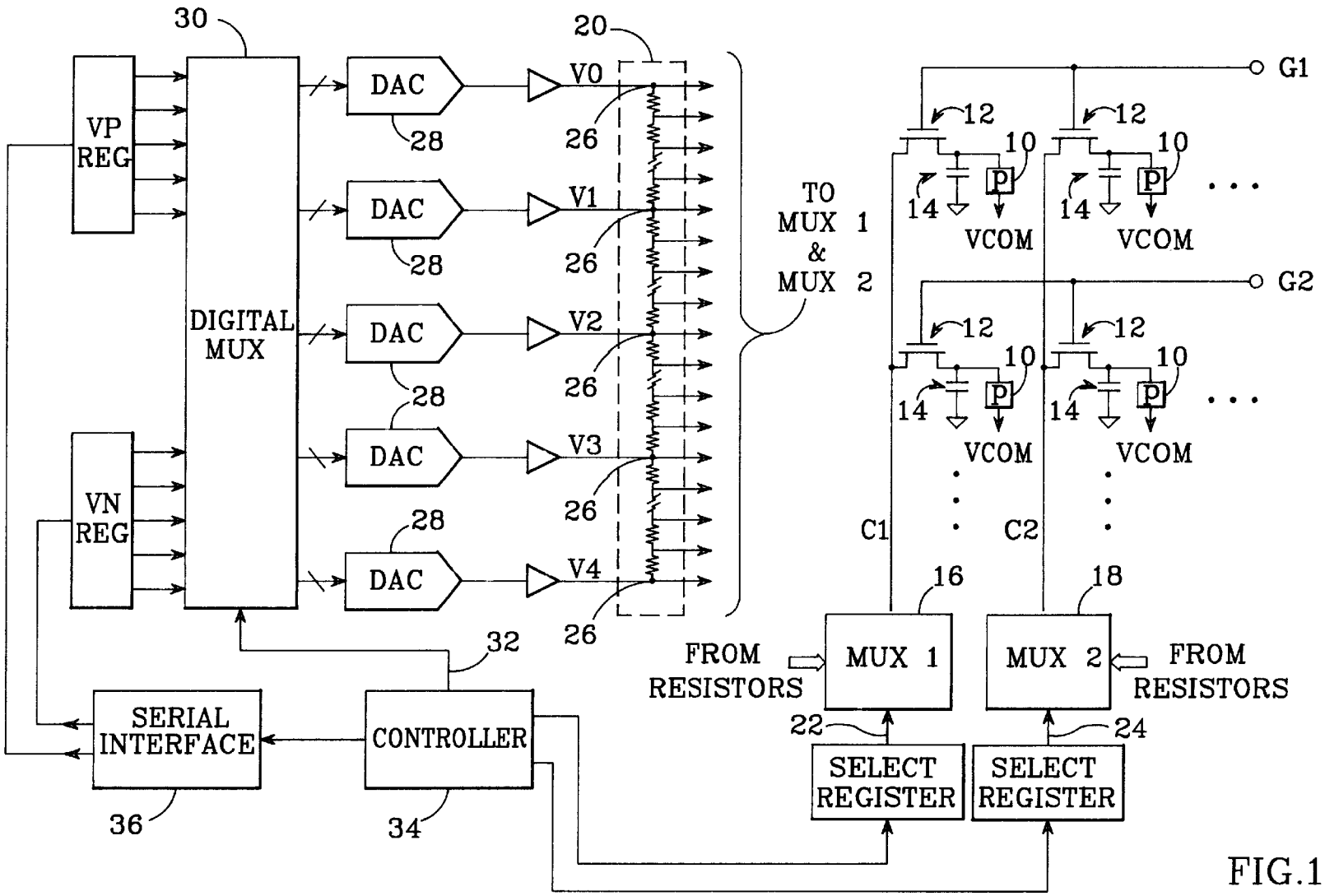
FIG. 1 is a grayscale reference generator per the present invention.
Figure 2:
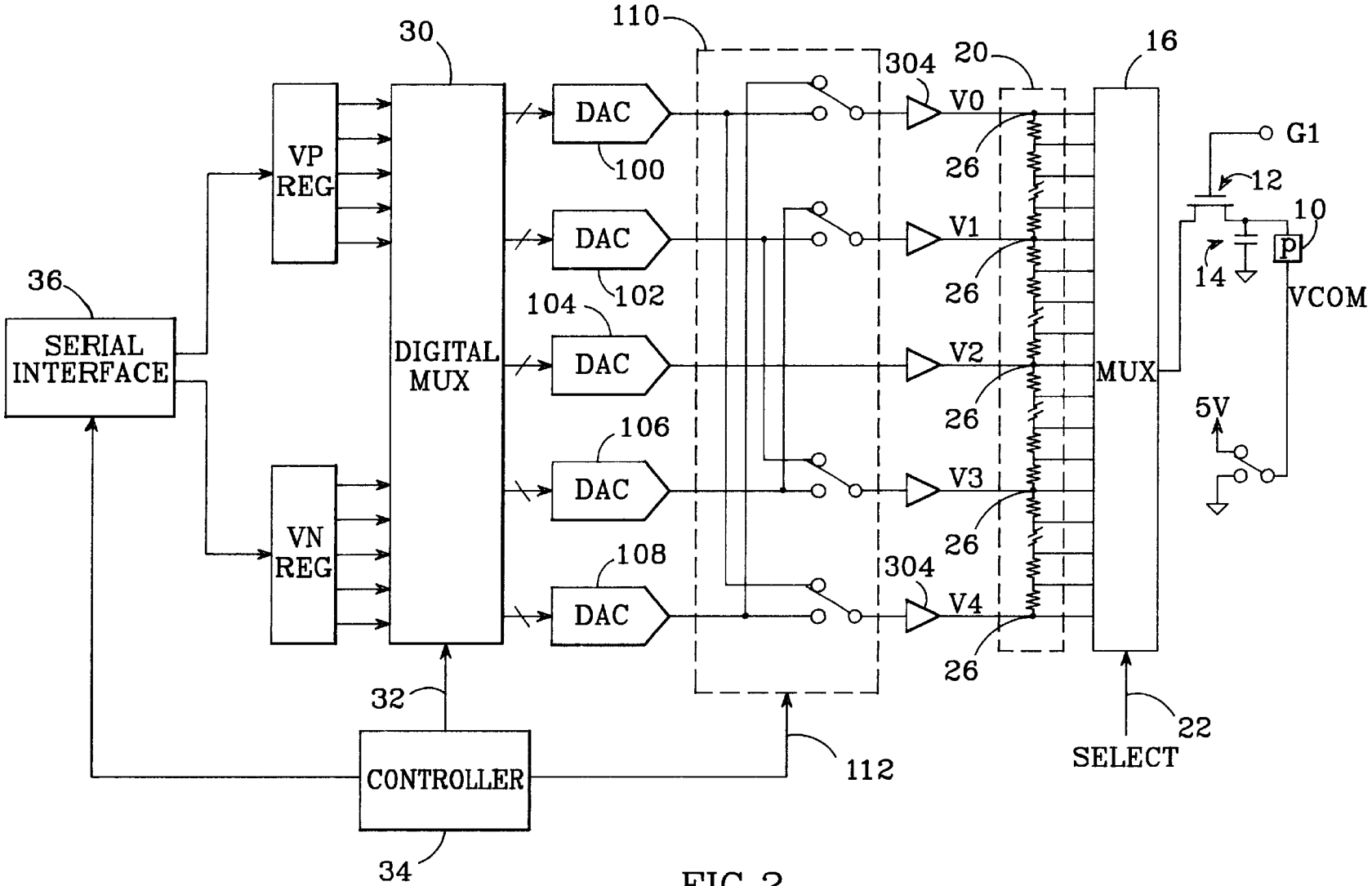
FIG. 2 is a block diagram of a preferred embodiment of a grayscale reference generator per the present invention.

A grayscale reference generator is accordance with the present invention is shown in FIG. 1. The present generator is suitable for use with an LCD display; the display could be color or grayscale, and might be used, for example, as a cell phone display, an LCD television or computer monitor, a digital camcorder viewfinder, or a car navigation system. An exemplary LCD display as might be used with the generator comprises a 2 row by 2 column array of pixels 10 (though a practical display would typically include thousands of such pixels). A pixel is addressed by toggling the "gate" line (G1, G2) for the row in which the pixel resides, which closes switches 12 to connect the pixel to a particular column line (C1, C2). A desired drive voltage is then applied to the pixel's column line, and is stored on a storage capacitor 14. To avoid ghosting, one terminal of each pixel 10 is connected to a voltage VCOM, which is alternately switched between first and second voltages—typically a positive supply voltage and ground (as shown in FIG. 2, discussed below), but any two voltages could be used.

Each column line is driven with a source driver as described above. The inputs of multiplexers 16 and 18 are connected to receive numerous voltages from the resistor-resistor junctions of a powered resistor string 20, with the output of each multiplexer connected to a respective column line. Multiplexers 16 and 18 also receive respective digital code SELECT signals 22 and 24. In response to the SELECT signals, each mux connects one of the voltages received from series resistor string 20 to its column line. To correct pixel non-linearity, a number of connection points 26 are made accessible along resistor string 20, each of which is connected to a respective correction voltage; in the example shown in FIG. 1, there are 5 such connection points, connected to 5 correction voltages V0–V4.

Correction voltage V0–V4 are provided by respective DACs 28, each of which is preferably driven by an output of a digital multiplexer 30. Digital mux 30 receives as inputs two sets of digital code words: one set, from a "VP" register, is used to drive DACs 28 when the polarity across an addressed pixel is positive, and a second set, from a "VN" register, is used to drive DACs 28 when the polarity across an addressed pixel is negative. Digital mux 30 selects between the registers in response to a select signal 32. The present grayscale reference generator preferably includes a controller 34 which switches digital multiplexer 30 between registers VP and VN in synchronization with signal VCOM, and controls drive voltage selection via multiplexers 16 and 18. The VP and VN registers typically receive their contents from a serial interface 36, which is also controlled by controller 34. This arrangement enables display non-idealities to be corrected: by using appropriate values in the VP and VN registers, different correction voltages can be generated to correct pixel non-linearity depending on the pixel's drive voltage polarity. This approach cuts the number of DACs required to provide the necessary correction voltages—including correction for display non-idealities—in half (when compared with the prior art approach described above).

Note that for a practical display, there would be a large number of pixels arranged into rows and columns, with each column driven with a respective multiplexer like mux 16, each of which would be connected to receive the drive voltages produced by series resistor string 20.

The generator shown in FIG. 1 represents a clear improvement over the prior art, but the remaining DACs are still required to cover the full pixel voltage range, which, as noted above, is inefficient in terms of both power consumption and die area.

This shortcoming is addressed with the preferred embodiment of the present grayscale reference generator, shown in FIG. 2. As before, the generator produces correction voltages V0–V4, which would be connected to respective ones of connection points 26. The grayscale reference generator includes a number of DACs 100, 102, 104, 106, 108. The number of DACs required is equal to the number of correction voltages which need to be provided to the source driver. For example, if a particular application required five correction voltages, the source driver's series resistor string should have five connection points, and the present generator would include five DACs.

An analog multiplexer 110 is interposed between the DAC outputs and the connection points 26 of resistor string 20; analog mux 110 selects a DAC output to provide a given correction voltage in response to a control signal 112. For example, as shown in FIG. 2, analog mux 110 can select either the output of DAC 100 or the output of DAC 108 to provide correction voltage V0. This arrangement enables each of DACs 100, 102, 104, 106 and 108 to cover only a limited portion of the pixel voltage range. For example, if the display requires 0–5 volts to fully exercise its pixels, then DACs 100, 102, 104, 106 and 108 can be arranged to cover 0–1V, 1–2V, 2–3V, 3–4V, and 4–5V, respectively.

To avoid ghosting, the polarity of the voltage across an addressed pixel alternates between positive and negative; this requires the drive voltage to change each time VCOM changes state. The is accommodated using analog multiplexer 110, as follows: assume that the DACs have output voltage ranges as in the example above, and that a pixel requires an applied voltage of 0.5 volts. When the polarity across the pixel is to be positive (VCOM=0V), analog mux 110 is commanded (via control signal 112) to select DAC 100 to provide correction voltage V0. The output voltage range of DAC 100 is 0–0V, and thus the necessary 0.5 volt pixel voltage is selected from the uppermost segment of resistor string 20 via mux 16. When the polarity across the pixel is switched (VCOM=5V), analog mux 110 is commanded to select DAC 108 to provide correction voltage V0. Mux 16 remains connected to the same resistor-resistor junction which previously provided the 0.5 volt drive voltage, but now with DAC 108 providing V0, the selected junction provides the necessary 4.5 volt drive voltage. Similarly, analog mux 110 alternately selects DACs 102 and 106 to provide correction voltages V1 and V3. In this manner, the requirement that each DAC cover the entire pixel voltage range is eliminated. Select signal 112 is provided by controller 34, which switches analog multiplexer 110 in synchronization with signal VCOM.

Figure 3:
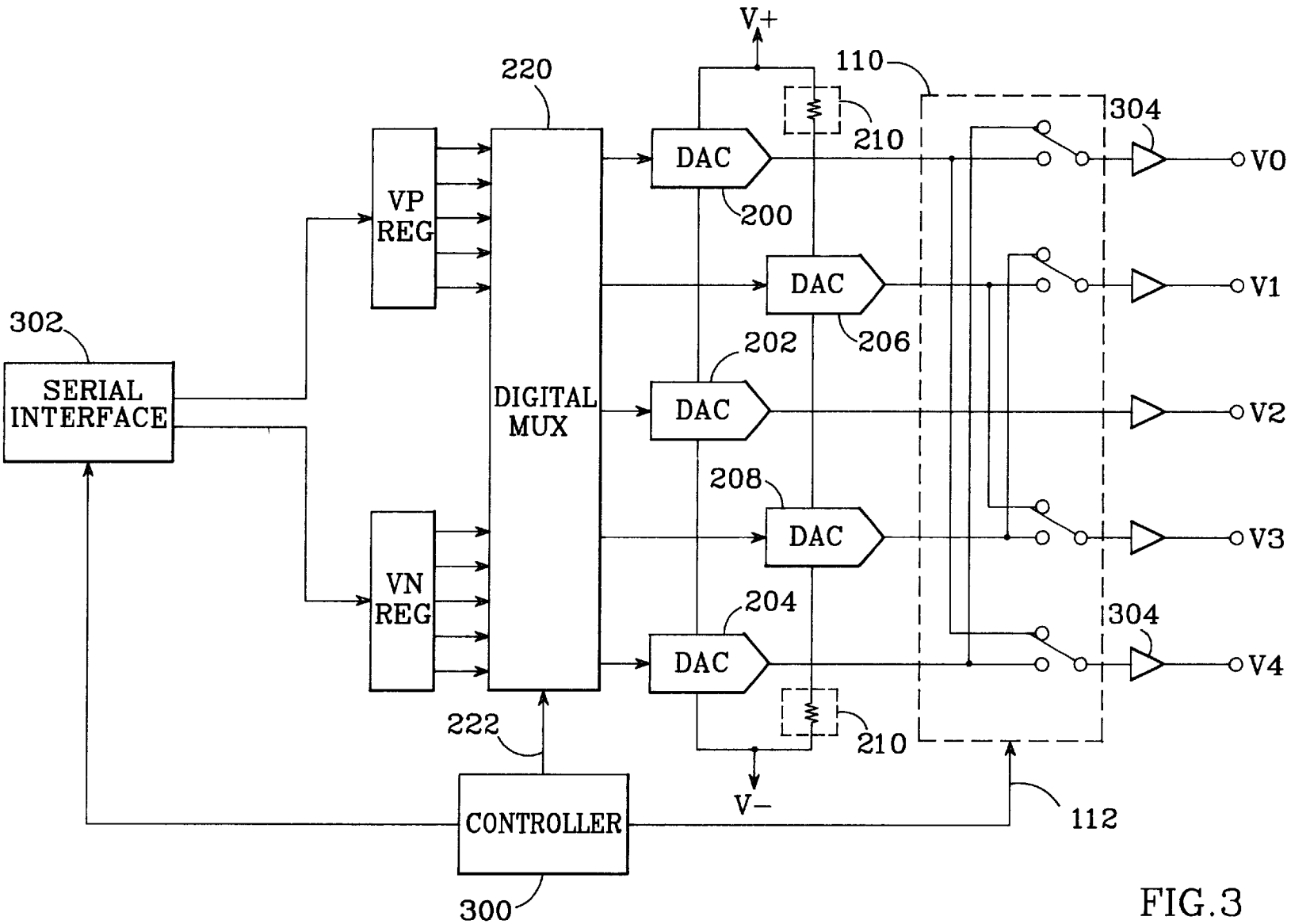
FIG. 3 is a block diagram of another embodiment of a grayscale reference generator per the present invention.

Since the DACs no longer need to cover the full pixel voltage range, they can be connected in series as shown in FIG. 3, with three series-connected DACs (200, 202, 204) and two series-connected DACs (206, 208) connected between supply voltages V+ and V−. These DACs are effectively resistors, such that connecting them between V+ and V− causes the supply voltage (V+−V−) to be equally divided across the DACs which are connected together. For example, assuming that V+ is 5 volts and V− is ground, then DAC 200 receives 5 volts on one supply pin and (2*5)/3=

3.33 volts on its other supply pin. DAC 202 receives 3.33 volts and 5/3=1.66 volts on its supply pins, and DAC 204 is supplied with 1.66 volts and 0 volts. The generator is arranged such that DAC 206 receives (5*5)/6=4.166 volts and 5/2=2.5 volts at its supply pins, and that DAC 208 is supplied with 5/2=2.5 volts and 5/6=0.833 volts. The resistors 210 above and below DACs 206 and 208 are used to equalize the LSB size between the three cascaded DACs (200, 202, 204) and the two cascaded DACs (206, 208).

This arrangement provides reduced power consumption when compared with 5 DACs which must each cover the full pixel voltage range. Furthermore, the resolution of each DAC can be reduced, while still offering an LSB size comparable to a DAC which covers the full pixel voltage range. The reduced power consumption and reduced resolution also enable the die area of each DAC to be reduced.

Figure 4:
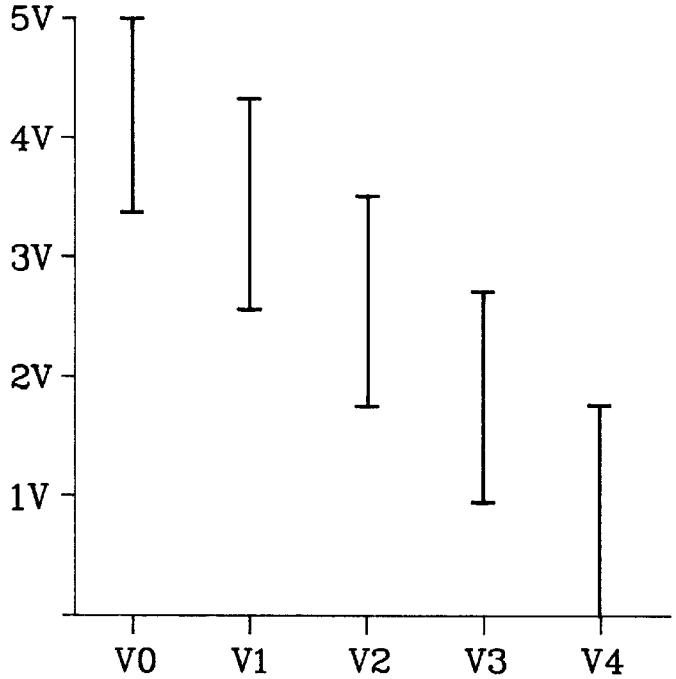
FIG. 4 depicts two graphs which illustrate the output voltage ranges produced by respective DACs for both positive and negative pixel voltage polarities.
Figure 4:
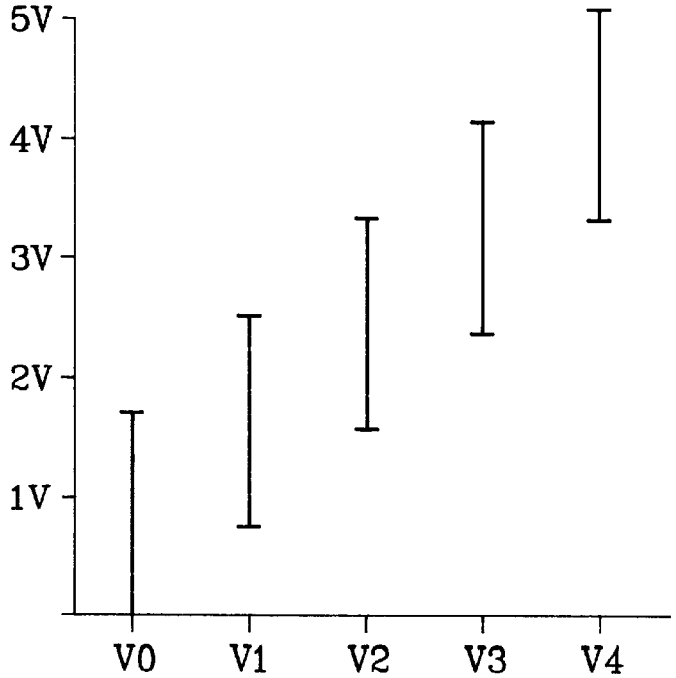

As previously noted, because of display non-idealities, when the voltage polarity across a pixel is reversed, different correction voltages may be required to correct for pixel non-linearity. Referring back to FIG. 2, this is accommodated using digital multiplexer 30, which passes one of two sets of digital code words from registers VP and VN to DACs 100, 102, 104, 106, 108 in response to control signal 32 from controller 34. Multiplexer 30 is switched between the VP and VN registers in synchronization with VCOM. When so arranged, two different correction curves can be generated by the DACs. This is illustrated in FIG. 4. The uppermost graph shows the overlapping correction voltage ranges which might be provided by DACs 100, 102, 104, 106 and 108 when driven by the VP register, and the lower graph shows the correction voltage ranges provided by the DACs when driven by the VN register.

The present generator also preferably includes buffer amplifiers 304, which buffer correction voltages V0–V4 prior to their connection to connection points 26.

Note that the number of DACs shown in FIGS. 2 and 3 is merely exemplary; the present invention is easily scaled up or down to provide more or less than five correction voltages.

The correction voltages applied to the connection points form a piece-wise linear curve, which should approximate the inverse of the pixel's voltage/transparency relationship. Thus, the number of correction voltages required for a particular system (and thus the number of DACs) is application-dependent. The approximation improves with the number of connection points used. Display panels which do not require a high degree of performance, such as a cell phone display, may have as few as four correction points. Higher performance displays, such as an LCD television, may have 10 or more connection points.

The generator is used whenever the voltages provided to the display pixels are updated. The generator components may be powered down at other times to save power. The panel manufacturer typically has measurements of a particular panel's voltage/transparency relationship, which is combined with experimental data to determine what the shape of the correction curve should be. With this data in hand, the correction curve can be shifted up or down during manufacture to adjust for flicker, and/or the end points can be adjusted to yield good contrast and brightness performance. Also, the user may be allowed to adjust the correction values in order to adjust for contrast, brightness, etc.

While particular embodiments of the invention have been shown and described, numerous variations and alternate embodiments will occur to those skilled in the art. Accordingly, it is intended that the invention be limited only in terms of the appended claims.

I claim:

1. A grayscale reference generator suitable for use with a liquid-crystal device (LCD) display, comprising:

a source driver suitable for switching one of a plurality of drive voltages to a column of LCD pixels in response to a digital code word, the transparency of each of said pixels varying over a predetermined pixel voltage range, each of said pixels receiving said selected drive voltage at its first terminal and alternately switched between first and second voltages at its second terminal, said source driver comprising a plurality of resistors connected in series and having accessible connection points at each end of said series string and at various resistor-resistor junctions along said series string, said series string producing at least some of said drive voltages when said connection points are connected to respective correction voltages, a plurality of digital-to-analog converters (DACs), each of which is arranged to output a respective one of said correction voltages in response to a digital code word, each of said DACs arranged such that its respective correction voltage is variable over at least a portion of said predetermined pixel voltage range, wherein said correction voltages define a respective number of points along a piece-wise linear curve which compensates for the non-linear relationship between the absolute voltage across an LCD pixel and its transparency, and a digital multiplexer which receives first and second sets of digital code words at its inputs and which selectably provides one of said sets of digital code words to respective ones of said DACs in response to a control signal, said first set of digital code words arranged to produce correction voltages which compensate for pixel non-linearities when the voltages across said pixels are of a first polarity and said second set of digital code words arranged to produce correction voltages which compensate for pixel non-linearities when the voltages across said pixels are of a second polarity, said digital multiplexer switching between said first and second sets of digital code words in synchronization with the switching of said pixels' second terminal.

2. The grayscale reference generator of claim 1, further comprising an analog multiplexer connected between said DAC outputs and said resistor connection points and arranged to connect said DAC outputs to respective connection points such that said series string produces a desired array of drive voltages, said analog multiplexer arranged to switch the DAC outputs connected to said connection points in synchronization with the switching of said pixels' second terminal such that the polarity of the voltages across said pixels is periodically reversed, each of said DACs arranged such that its respective correction voltage is variable over a limited portion of said predetermined pixel voltage range.

3. A grayscale reference generator suitable for use with a liquid-crystal device (LCD) display, comprising:

a source driver suitable for switching one of a plurality of drive voltages to a column of LCD pixels in response to a digital code word, the transparency of each of said pixels varying over a predetermined pixel voltage range, each of said pixels receiving said selected drive voltage at its first terminal and alternately switched between first and second voltages at its second terminal, said source driver comprising a plurality of resistors connected in series and having accessible connection points at each end of said series string and at various resistor-resistor junctions along said series string, said series string producing at least some of said drive voltages when said connection points are connected to respective correction voltages, a plurality of digital-to-analog converters (DACs), each of which is arranged to output a respective one of said correction voltages in response to a digital code word, each of said DACs arranged such that its respective correction voltage is variable over a limited portion of said predetermined pixel voltage range, and an analog multiplexer connected between said DAC outputs and said resistor connection points and arranged to connect said DAC outputs to respective connection points such that said series string produces a desired array of drive voltages, said analog multiplexer arranged to switch the DAC outputs connected to said connection points in synchronization with the switching of said pixels' second terminal such that the polarity of the voltages across said pixels is periodically reversed.

4. The grayscale reference generator of claim 3, wherein said correction voltages define a respective number of points along a piece-wise linear curve which compensates for the non-linear relationship between the absolute voltage across an LCD pixel and its transparency, further comprising a digital multiplexer which receives first and second sets of digital code words at its inputs and which selectably provides one of said sets of digital code words to respective ones of said DACs in response to a control signal, said first set of digital code words arranged to produce correction voltages which compensate for pixel non-linearities when the voltages across said pixels are of a first polarity and said second set of digital code words arranged to produce correction voltages which compensate for pixel non-linearities when the voltages across said pixels are of a second polarity, said digital multiplexer switching between said first and second sets of digital code words in synchronization with the switching of said pixels' second terminal.

5. The grayscale reference generator of claim 3, wherein said correction voltages define a respective number of points along a piece-wise linear curve which compensates for the non-linear relationship between the absolute voltage across a pixel and its transparency.

6. The grayscale reference generator of claim 3, wherein said DACs are arranged such that their respective correction voltages are variable over respective voltage ranges which together cover all of said predetermined pixel voltage range, the output voltage range of each DAC overlapping with the output voltage range of at least one other DAC.

7. The grayscale reference generator of claim 6, wherein at least some of said DACs are series-connected between a pair of supply voltages.

8. The grayscale reference generator of claim 3, wherein said source driver further comprises a drive voltage multiplexer which receives said plurality of drive voltages at respective inputs and which outputs a selected one of said drive voltages in response to said digital code word provided to said source driver.

9. The grayscale reference generator of claim 8, further comprising an array of LCD pixels arranged into columns and rows, each column of said array driven by a respective one of said drive voltage multiplexers, each of said drive voltage multiplexers connected to receive said plurality of drive voltages at respective inputs and to output a selected one of said drive voltages in response to a digital code word.

10. A liquid-crystal device (LCD) display system which includes a grayscale reference generator, said system comprising:

an array of LCD pixels arranged into X columns and Y rows, the transparency of each of said pixels varying over a predetermined pixel voltage range, each of said pixels driven with a respective drive voltage at its first terminal and alternately switched between first and second voltages at its second terminal, X source drivers connected to provide respective drive voltages to respective ones of said columns of LCD pixels in response to respective digital code words, each of said source drivers comprising a drive voltage multiplexer which receives a plurality of drive voltages at respective inputs and which outputs a selected one of said drive voltages to said source driver's respective LCD pixel column in response to a digital code word provided to said drive voltage multiplexer, a resistor network comprising a plurality of resistors connected in series and having accessible connection points at each end of said series string and at various resistor-resistor junctions along said series string, said resistor network producing at least some of said drive voltages when said connection points are connected to respective correction voltages, a plurality of digital-to-analog converters (DACs), each of which is arranged to output a respective one of said correction voltages in response to a digital code word, said DACs arranged such that their respective correction voltages are variable over respective limited portions of said predetermined pixel voltage range and which together cover all of said predetermined pixel voltage range, the limited voltage range of each DAC overlapping with the voltage range of at least one other DAC, an analog multiplexer connected between said DAC outputs and said resistor connection points and arranged to connect said DAC outputs to said connection points such that said plurality of resistors produces a desired array of drive voltages, said analog multiplexer arranged to switch the DAC outputs connected to said connection points in synchronization with the switching of said pixels' second terminal such that the polarity of the voltages across said pixels is periodically reversed, said system arranged such that said correction voltages define a respective number of points along a piece-wise linear curve which compensates for the non-linear relationship between the absolute voltage across an LCD pixel and its transparency, and a digital multiplexer which receives first and second sets of digital code words at its inputs and which selectably provides one of said sets of digital code words to respective ones of said DACs in response to a control signal, said first set of digital code words arranged to produce correction voltages which compensate for pixel non-linearities when the voltages across said pixels are of a first polarity and said second set of digital code words arranged to produce correction voltages which compensate for pixel non-linearities when the voltages across said pixels are of a second polarity, said digital multiplexer switching between said first and second sets of digital code words in synchronization with the switching of said pixels' second terminal.

11. The grayscale reference generator of claim 10, wherein at least some of said DACs are series-connected between a pair of supply voltages V+ and V− such that the supply voltage (V+–V−) is equally divided across the series-connected DACs which are connected together.

12. The grayscale reference generator of claim 10, further comprising a controller which operates said analog multiplexer, said digital multiplexer, and said pixel terminal switches.

13. The grayscale reference generator of claim 10, further comprising a plurality of buffer amplifiers connected between respective ones of said analog multiplexer outputs and said resistor connection points.

* * * * *